United States Patent [19]

Haley

[11] 4,269,239

[45] May 26, 1981

[54] TRAVELING LOADING ARM FOR MARINE TANKERS

[75] Inventor: Frank P. Haley, Upland, Calif.

[73] Assignee: FMC Corporation, San Jose, Calif.

[21] Appl. No.: 48,915

[22] Filed: Jun. 15, 1979

Related U.S. Application Data

[63] Continuation of Ser. No. 950,190, Oct. 10, 1978, abandoned.

[51] Int. Cl.[3] ..... B65B 3/04; F17D 1/00

[52] U.S. Cl. ..... 141/387; 137/615

[58] Field of Search ..... 114/74 R; 137/236, 615; 141/231, 233, 279, 284, 387, 388

[56] References Cited

U.S. PATENT DOCUMENTS

| | | | |
|---|---|---|---|
| 1,084,889 | 1/1914 | Mackie . | |
| 3,974,864 | 8/1976 | Fournier et al. | 141/387 |

*Primary Examiner*—Frederick R. Schmidt

*Attorney, Agent, or Firm*—L. B. Guernsey; W. W. Ritt, Jr.

[57] ABSTRACT

A traveling articulated loading arm movably mounted on the deck of a marine tanker for transferring fluid between a flexible hose along either side of the tanker and manifold ports at various locations along the tanker centerline. The arm can be extended sufficiently beyond either side of the tanker to enable connection of the hose to the arm without having to bend the hose over the tanker railing, and petroleum and other fluid from the hose can be directed into any of the tanker holds by connecting the inboard end of the arm to the proper manifold inlet. The arm can be moved like an inchworm from one side of the tanker to the other by connecting the inboard end to a first manifold flange or other appropriate support at the tanker centerline, bringing the outboard end in and connecting it to a second manifold flange or support closely adjacent the inboard end, and then disconnecting the inboard end from the first flange or support and extending it out to its functional position at the other side of the tanker. The arm also is provided with a hydraulic system for maneuvering the arm sections, for operating couplers to connect it to manifold or other flanges, and for powering jacks to adjust the position of the couplers with respect to said flanges.

14 Claims, 9 Drawing Figures

TRAVELING LOADING ARM FOR MARINE TANKERS

This is a continuation of application Ser. No. 950,190 filed Oct. 10, 1978, now abandoned.

BACKGROUND OF THE INVENTION

1. Field of the Invention

This invention relates to articulated marine loading arms, and more particularly to loading arms movable across the deck of a tanker to facilitate loading the tanker from either side.

2. Description of the Prior Art

The production of oil and gas from offshore wells has developed into a major endeavor of the petroleum industry, and this growth has fostered extensive interest and investigation into means for transporting the produced fluids to shore-based refineries or storage facilities. Although in many instances pipelines are employed for this purpose, more and more wells are being drilled and completed in deep water locations where the use of marine tankers of very large capacity constitutes the most practical and efficient transportation method, such as where pipelines would be too costly or too difficult to construct.

One of the more common types of offshore loading facilities includes a buoy or other floating platform to which the tanker may be moored while loading, and to which are connected a number of flexible hoses for transferring fluid between the buoy or platform and the tanker. The flexible hoses may be either floating on the surface of the water or submerged beneath the surface, and are usually provided with a tag line to enable the end of the hose to be picked up and pulled over the side of the tanker for connection to the tanker manifold.

Because of their large size these hoses are actually quite stiff, cumbersome, and not well adapted to bend in a tight radius, and therefore exertion of a substantial tension on the end of the hose is required in order to flex it over the side of the vessel and bring it to the manifold port. Such progressive flexing of the hose can abrade and seriously weaken it, thereby reducing its service life and also creating a real danger of possible rupture and spillage of the petroleum or other fluid being transferred.

What is needed is a means to connect the hose in an unbent vertical attitude to the tanker manifold. It also is desirable that the hose can be connected on either side of the ship to the apparatus which transports the fluid between the end of the hose and the tanker manifold port.

SUMMARY OF THE INVENTION

The present invention comprises a traveling loading arm for mounting on the deck of a marine tanker for transferring fluid from a hose on either side of the tanker to manifold ports mounted on the tanker deck. This invention overcomes some of the disadvantages of the prior art by employing a pair of lengths of pipe pivotally joined together to form an articulated pipe assembly which can be extended over the side of the tanker and can be connected to a petroleum transfer hose without bending the hose over the tanker's railing. The articulated pipe assembly is mounted on a support carriage at either end and the carriages are movably mounted on a set of support rails so that the pipe assembly can be moved to a position with one end of the assembly extending over one side of the tanker and the other end connected to one of the several manifold ports located amidship. The pipe assembly can be quickly moved along the support rails and the ends of the assembly secured in position, so that the tanker can be loaded or unloaded from either the port or the starboard side.

The inboard end of the pipe assembly can be quickly disconnected from one of the manifold ports and connected to another manifold port without the need for disconnecting the outboard end from the petroleum transfer hose. The present invention allows the different holds of the tanker to be filled from a petroleum transfer hose positioned on either side of the tanker without changing the transfer hose, and allows the tanker manifold ports to be positioned amidship without any permanently connected pipes between the manifold ports and the sides of the tanker.

When the loading operation is completed the end of the pipe assembly which was connected to the petroleum transfer hose, can be disconnected from the hose and connected to one of the tanker manifold ports for storage and for draining the petroleum from the pipe assembly into the tanker's hold. The traveling loading arm can be moved across the tanker's deck in the manner of an inchworm by locking the brakes on a first one of the carriages at the end of the articulated arm and moving the second carriage to position the second end of the articulated arm adjacent the first end of the articulated arm. The brake on the second carriage can then be locked and the first carriage moved to place the articulated arm in the desired position.

DESCRIPTION OF THE PREFERRED EMBODIMENT

A traveling loading arm according to the present invention comprises an articulated pipe assembly 10 (FIGS. 1, 2, 6–9) supported at either end by a support carriage 11*a*, 11*b* movably mounted on a pair of support rails 12*a*, 12*b* (FIG. 1) or other suitable support structure. The support rails 12*a*, 12*b* are mounted transversely on a deck 15 of a marine tanker 16 to facilitate easy movement of the loading arm across the tanker's deck.

Figure 1:
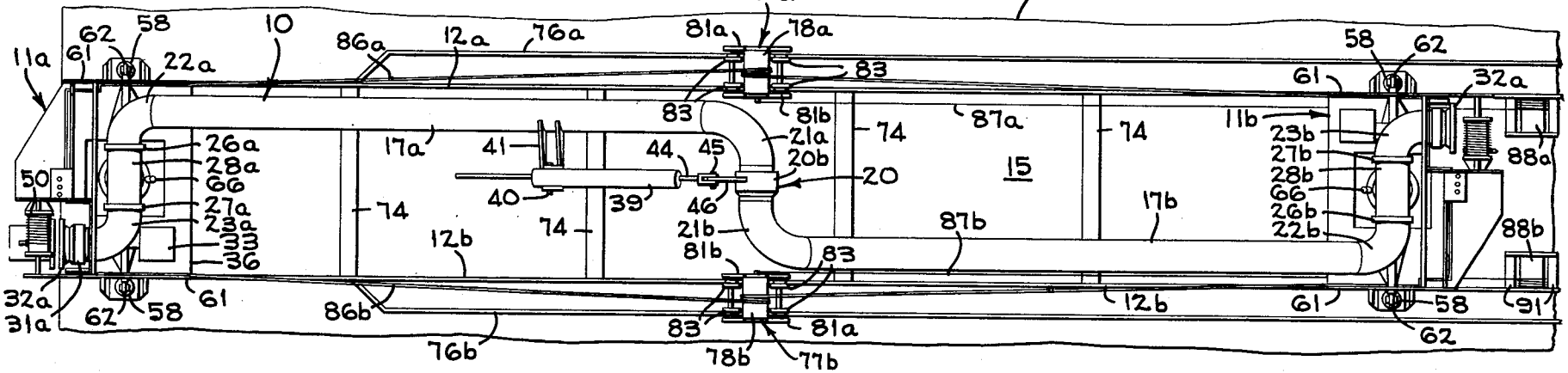
FIG. 1 is a plan view of a traveling loading arm mounted on the deck of a marine tanker according to the present invention.
Figure 2:
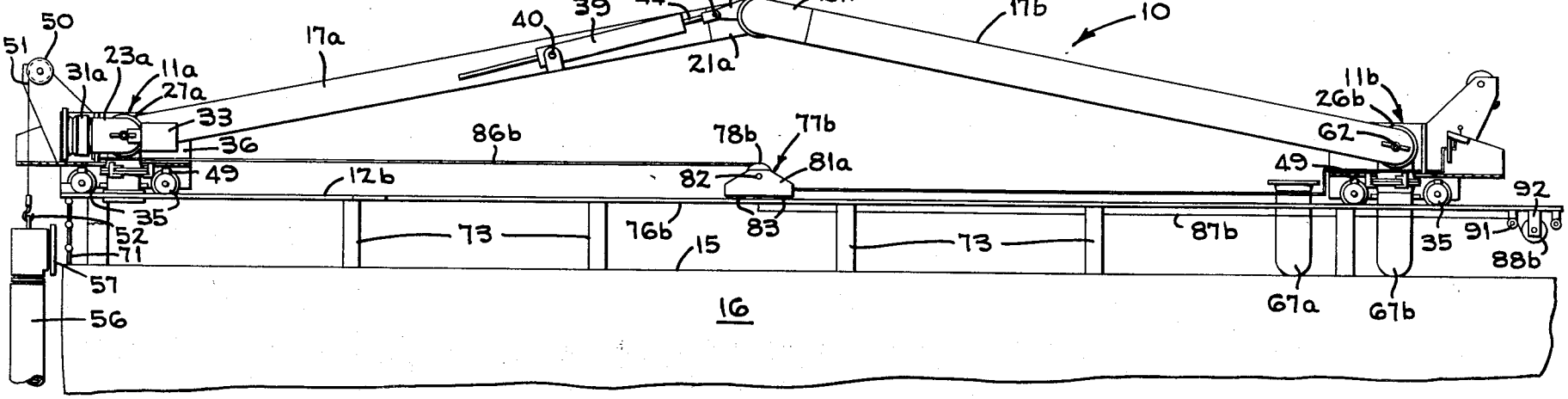
FIG. 2 is a side elevation of the traveling loading arm of FIG. 1.
Figure 4:
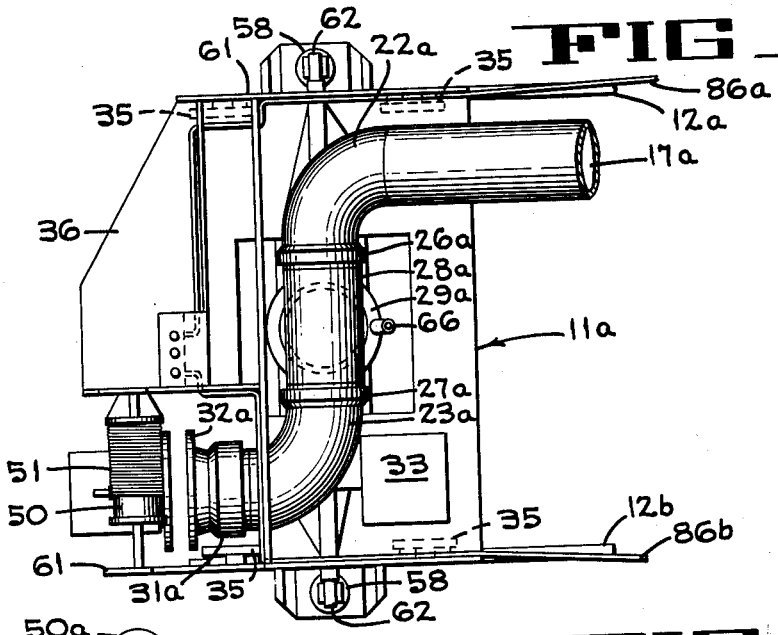
FIG. 4 is a plan view of the end of the arm shown in FIG. 3.

The articulated pipe assembly 10 includes a pair of lengths (FIGS. 1 and 2) of pipe 17*a*, 17*b* pivotally connected together at the ends by a swivel joint 20 and by a pair of pipe elbows 21*a*, 21*b* (FIG. 1). The left end portion of the pipe assembly 10 includes a pair of pipe elbows 22*a*, 23*a* (FIGS. 1,4) interconnected by a pair of swivel joints 26*a*, 27*a* and by a T-section of pipe 28*a*.

The T-section 28*a* includes a flange 29*a* (FIG. 4) for connection to the tanker's manifold port.

Another swivel joint 31*a* connects a spool flange 32*a* to the pipe elbow 23*a*. A counterweight 33 (FIGS. 1, 4, 5) counterbalances the weight of the swivel joint 31*a* and the spool flange 32*a* about the axis of the swivel joint 27*a*. The right end portion of the pipe assembly 10 (FIG. 1) similarly includes a plurality of pipe elbows 22*b*, 23*b*, a pair of swivel joints 26*b*, 27*b*, a spool flange 32*b* and a T-section 28*b*. Each end of the articulated pipe assembly 10 can be connected either to a petroleum transfer hose or to a tanker's manifold port. The T-section 28*a*, 28*b* can be connected to any of the tanker's manifold ports while either of the spool flanges 32*a*, 32*b* can be connected to a petroleum transfer hose. When the flange 29*a* of the T-section 28*a* is not connected to either a manifold port or to a dummy flange, a cover plate (not shown) must be secured to the flange 29*a* to prevent leakage of fuel from the T-section. A cover plate must also be secured to the spool flanges 32*a*, 32*b* to prevent leakage when either of these flanges is not connected to a petroleum transfer hose.

Power to manipulate the articulated pipe assembly 10 is provided by a hydraulic cylinder 39 (FIGS. 1 and 2) which is connected by a pin 40 to a bracket 41. The bracket 41 is welded or otherwise connected to the length of pipe 17*a* and a piston rod 44 of the hydraulic cylinder is connected by a pin 45 and an ear 46 to the swivel joint 20. The ear 46 is welded or otherwise connected to an outer portion 20*b* of the swivel joint 20 with the outer portion 20*b* being welded to the end of the elbow 21*b*. When the piston rod 44 is extended from the cylinder 39, the spool flanges 32*a*, 32*b* of the pipe assembly 10 are moved closer together and the pipe assembly folds toward the position shown in FIG. 7. When the piston rod 44 is retracted into the cylinder 39, the flanges 32*a*, 32*b* of the pipe assembly are moved farther apart and the pipe assembly 10 moves toward the position shown in FIG. 8.

Figure 3:
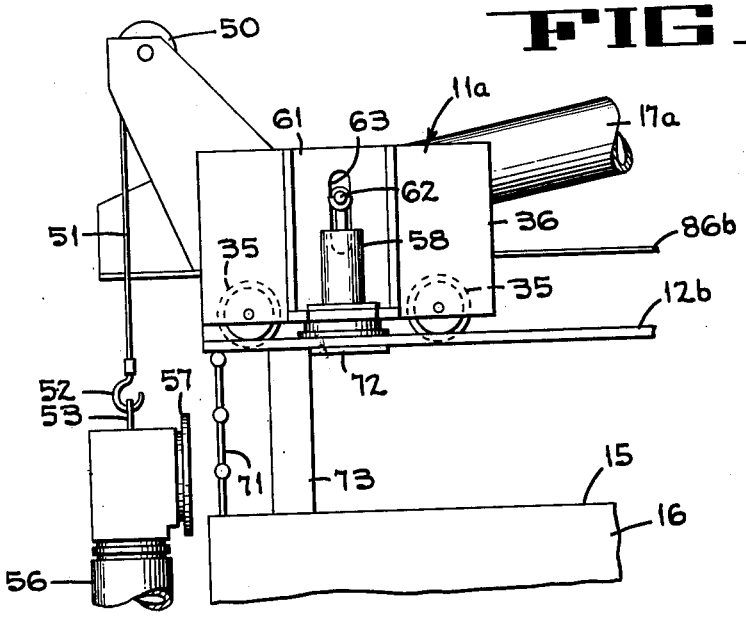
FIG. 3 is an enlarged side elevation of one end of the arm of FIG. 2.

Each of the support carriages 11*a*, 11*b* includes a plurality of support wheels 35 (FIGS. 1–5) rotatably connected to support a box-like body member 36. Adjacent each of the wheels is a braking device 49 (FIGS. 2 and 5) mounted to the body member 36 and with the device 49 selectively pressed against the wheels 35 to prevent the wheels from rotating. A winch 50 (FIGS. 2 and 3) having a cable 51 with a hook 52 attached at the end thereof is mounted at the end of the body member 36 for connection to an eye 53 attached to the end of a petroleum transfer hose 56 to enable the support carriage to lift the petroleum transfer hose 56 (FIGS. 2 and 3) from the water and into position for coupling to the end of the articulated pipe assembly 10. The upper end of the hose 56 includes a flange 57 for connection to the spool flange 32*a* (FIGS. 2 and 3) of the pipe assembly 10, with the connection being made by a hydraulic coupler (not shown) or by bolting the flanges 57 and 32*a* (FIG. 4) together.

Each of the supporting carriages 11*a*, 11*b* includes a pair of hydraulic jacks 58 (FIGS. 1, 3 and 4), with each of the jacks connected to a side wall 61 of the body member 36 and each connected to a pivot pin 62. The pivot pins 62 are each welded to one of the pipe elbows 22*a*, 22*b*, 23*a*, 23*b* so that the hydraulic jacks can raise or lower the pipe elbows and the T-sections 28*a*, 28*b* relative to the carriage wheels 35. A slot 63 (FIG. 3) in each of the side walls 61 limits the vertical travel of the pivot pins 62. A plurality of hydraulic couplers 66 (FIGS. 1, 2, 4 and 5) mounted on the lower portion of the T-section 28 secure the T-section to any one of a plurality of tanker manifold ports 67*a*–67*d* for loading or unloading petroleum or they can secure the end of the traveling loading arm to a dummy flange 68*a*, 68*b*. The manifold ports 67*a*–67*d* are connected to the various tanker holds while the dummy flanges 68*a*, 68*b* (FIGS. 6–9) are each mounted adjacent the ship's railing 71 on the support rails 12*a*, 12*b* by a plate 72 (FIGS. 2 and 5) which is welded or otherwise connected between the support rails 12*a*, 12*b* and one of the dummy flanges 68*a*, 68*b*. The dummy flange holds the outboard end of the loading arm in position for connection to the petroleum transfer hose.

The support rails 12*a*, 12*b* are secured just above the ship's railing 71 by a plurality of support members 73 (FIGS. 2, 5–9) to facilitate extending the outboard end of the support carriages 11*a*, 11*b* over the side of the tanker for easy connection to the petroleum transfer hose 56. A plurality of cross braces 74 (FIG. 1) are connected between the rails 12*a*, 12*b* to insure uniform spacing between the rails. An additional pair of hose drum support rails 76*a*, 76*b* (FIG. 1) are mounted parallel to the support rails 12*a*, 12*b* to provide support for a pair of hose drum carriages 77*a*, 77*b* (FIG. 1). Each of the hose drum carriages include a spring loaded drum 78*a*, 78*b* (FIGS. 1 and 2) connected to a pair of sidewalls 81*a*, 81*b* by a rod 82 (FIG. 2) and supported by a plurality of wheels 83 for movement over the rails 12*a*, 76*a* or 12*b*, 76*b*. The rails 12*a*, 12*b* are used for the support carriages 11*a*, 11*b* and for one half of the support of the hose drum carriages 77*a*, 77*b*.

The hose drum carriage 77*b* takes up the slack in a hydraulic control line 86*b* (FIGS. 1 and 2) which is connected between the support carriages 11*a*, 11*b*. The hydraulic line 86*b* provides hydraulic fluid under pressure to control the hydraulic winches 50*a*, 50*b* from a control console (not shown) which can be located on either of the carriage 11*a*, 11*b*. Additional hydraulic control lines can be added to control additional devices, for example, a hydraulic control line may be needed to control the operation of the hydraulic couplers 66. When the articulated pipe assembly is in the extended position (FIGS. 2 and 8) the hydraulic line 86*b* is unrolled from the drum 78*b* with the hydraulic line taut enough to be suspended above the tanker deck 15. When the articulated pipe assembly 10 is moved into a stored position (FIG. 7) the spring loaded drum 78*b* rotates to roll the hydraulic line 86*b* about the drum and keep the hydraulic lines from tangling along the tanker's deck 15.

An electrical cable 87*b* (FIG. 2) connected between the hose drum carriage 77*b* and a take up spool 88*b* provides electrical power to operate a brake (not shown) to prevent undesired movement of the hose drum carriage 77*b* along the rails 12*b*, 76*b* (FIG. 1). The cable 87*b* is threaded over one of the idler pullys 91 which are connected to the rail 12*b* and is connected to the underside of the carriage 77*b*. The take up spool 88*b* is also rotatably connected to the support rail 12*b* by a bracket 92 (FIG. 2) and is mounted near the center line of the tanker to provide convenient brake control signals to the hose drum carriage when the traveling loading arm is near either side of the tanker. The hose drum carriage 77*a*, a hydraulic line 86*a* (FIG. 1), electrical cable 87*a* and a take up spool 88*a* provide control of the operation of the hydraulic jacks 58.

Figure 5:
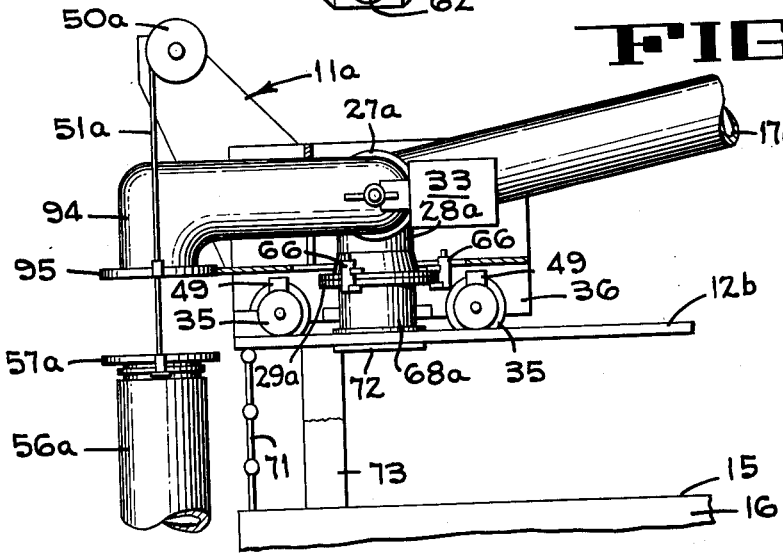
FIG. 5 is an enlarged side elevation of a second embodiment of one end of the traveling loading arm.

Another embodiment of the present invention is disclosed in FIG. 5 wherein an elbow 94 is connected to the outboard end of the traveling loading arm for connection to a petroleum transfer hose 56*a* having a straight end portion with a flange 57*a* at the end of the hose. A pair of cables 51*a* (only one of which is shown) are connected between a winch 50*a* and the flange 57*a* to lift the hose into position for connection to a flange 95 on the elbow 94.

Figure 6:
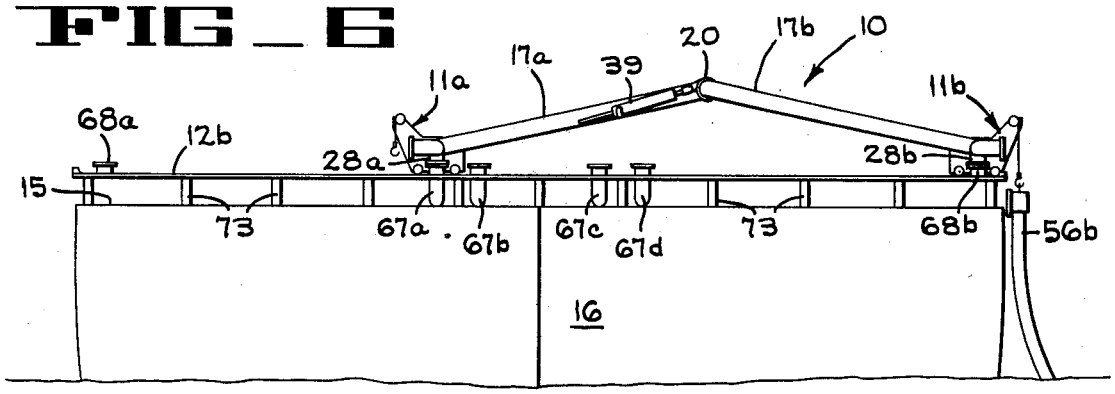
FIGS. 6–9 are schematic side elevations of the traveling loading arm of FIG. 1, showing a sequence of operation.
Figure 7:
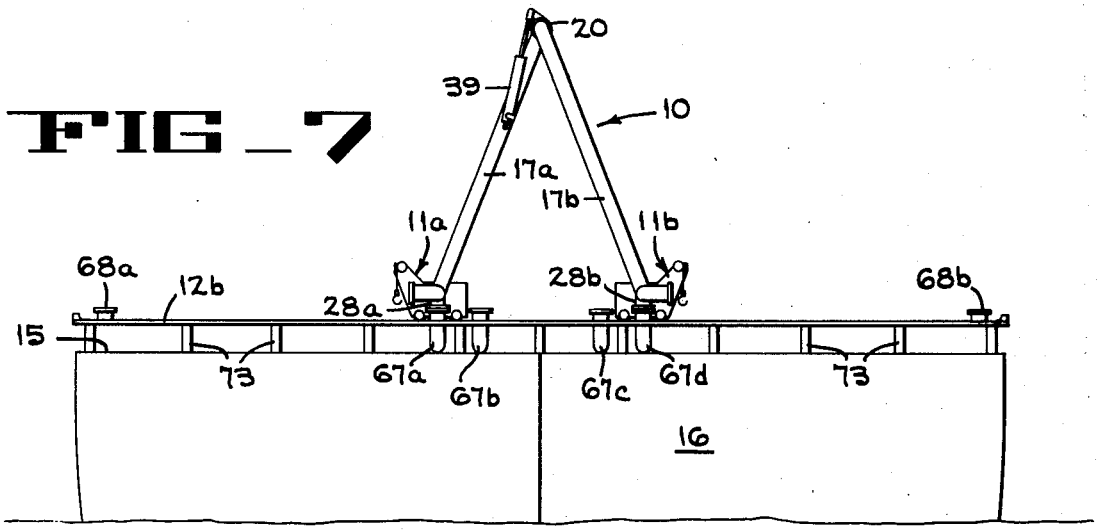
Figure 9:
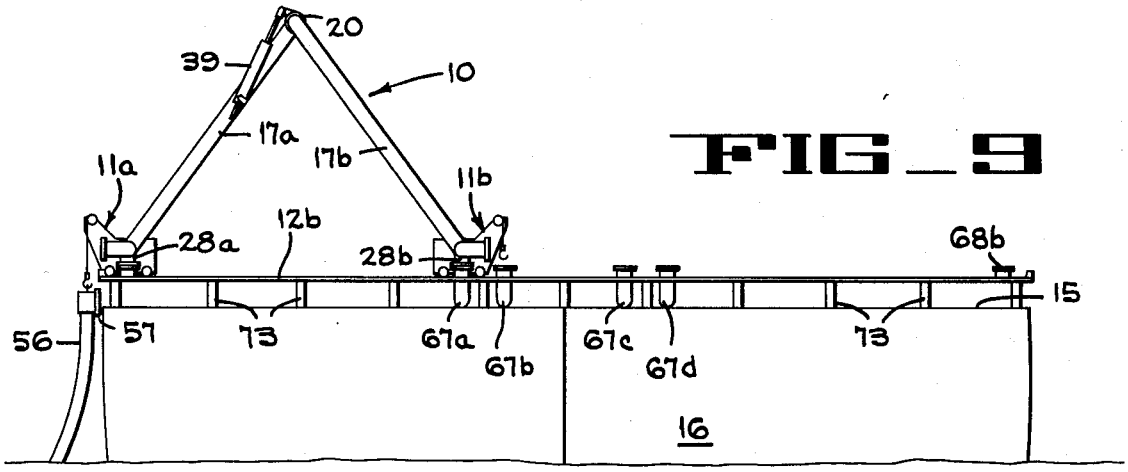
Figure 8:
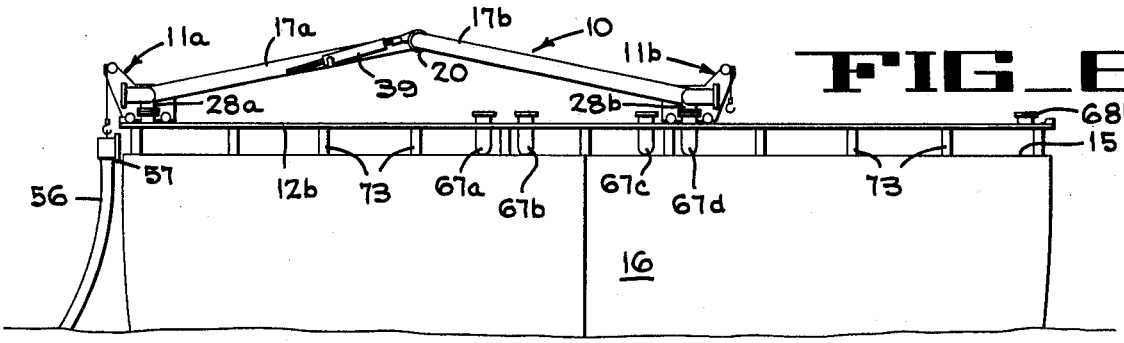

The procedure for moving the traveling loading arm from an operating position on the port side of a marine loading tanker 16 to a position on the starboard side of the tanker is shown sequentially in FIGS. 6–9. In FIG. 6 the articulated pipe assembly is shown in the extended position with the right end of the pipe assembly 10 connected to the dummy flange 68*b*, in position for connection to a petroleum transfer hose 56*b* and with the left end of the pipe assembly 10 connected to a first tanker manifold port 67*a* to provide fuel for one of the holds of the tanker 16. The left end of the pipe assembly can be moved to any of the desired manifold ports 67*b*–67*d* to fill the corresponding holds in the marine tanker 16. When the filling from the port side is completed the right end of the articulated pipe assembly 10 is disconnected from the dummy flange 68*b*, the hydraulic cylinder 39 is extended causing the articulated pipe assembly 10 to move to the collapsed position shown in FIG. 7. The T-section 28*b* on the right end of the pipe assembly 10 is then secured to the flange of the manifold port 67*d* (FIG. 7) and the T-section 28*a* on the left end of the pipe assembly is disconnected from the manifold port 67*a*. The hydraulic cylinder 39 is again collapsed so that the carriage 11*a* at the left end of the pipe assembly 10 moves to a position over the dummy flange 68*a* (FIG. 8) and the T-section 28*a* is clamped to the dummy flange 68*a* by the hydraulic coupler 66 (FIG. 5) thereby locking the articulated pipe assembly 10 in position to load the tanker from the starboard side into the manifold port 67*d* as shown in FIG. 8. The petroleum transfer hose 56 is connected to the left end of the pipe assembly 10 and fluid can then be transferred through the manifold port 67*d* into the tanker hold. The T-section 28*b* can be disconnected from the tanker's manifold port 67*d* and connected to any of the other manifold ports 67*a*–67*c*.

Thus, the present invention provides a traveling loading arm for conveniently loading a marine tanker from either side of the tanker and for connecting the loading arm between a petroleum transfer hose and any of the tanker's holds without pulling the transfer hose over the tanker's railing. The traveling loading arm can be easily stored in the position shown in FIG. 7 for draining fuel into the tanker manifold ports when the loading arm is not in use.

Although the best mode contemplated for carrying out the present invention has been herein shown and described, it will be apparent that modification and variation may be made without departing from what is regarded to be the subject matter of the invention.

I claim:

1. A traveling loading arm for mounting on the deck of a marine tanker for connecting a petroleum transfer hose to manifold ports mounted on said tankr deck, said loading arm comprising:

a pair of lengths of pipe pivotally joined together to form an articulated pipe assembly;

a pair of movable supports for mounting said pipe assembly for movement across said deck of said tanker;

means for connecting each of said supports to a corresponding one of the end portions of said pipe assembly;

guide means mounted on said deck of said tanker for guiding said supports as said supports move across said deck;

means for selectively connecting each end of said pipe assembly to one of said manifold ports;

means for selectively coupling either end of said pipe assembly to said petroleum transfer hose; and means for pivotally moving said lengths of pipe to position a first end of said pipe assembly relative to a second end of said pipe assembly.

2. A traveling loading arm as defined in claim 1 including means for extending the end of said pipe assembly over the side of said tanker for connection to said petroleum transfer hose.

3. A traveling loading arm as defined in claim 2 including means for lifting said petroleum transfer hose into position for connection to the end of said pipe assembly when said pipe assembly extends over the side of said tanker.

4. A traveling loading arm as defined in claim 1 including means for securing an end of said pipe assembly in a fixed position when said end of said pipe assembly is connected to said petroleum transfer hose.

5. A traveling loading arm as defined in claim 1 including means for connecting both ends of said pipe assembly to said manifold ports for storage and for draining the fuel from said pipe assembly.

6. A traveling loading arm for mounting on the deck of a marine tanker to selectively extend one end of said arm over either side of said tanker for connection to a petroleum transfer hose and to selectively connect the other end of said arm to any one of several manifold ports located amidships of said tanker, said loading arm comprising:

a pair of lengths of pipe pivotally joined together to form an articulate pipe assembly;

a pair of support carriages for mounting said pipe assembly for movement across the deck of said tanker;

means for mounting each end portion of said pipe assembly to a corresponding one of said support carriages;

support rails mounted on said deck of said tanker for guiding and supporting said carriages as said carriages move across said deck;

means for selectively coupling either end of said pipe assembly to said petroleum transfer hose;

means for selectively coupling either end of said pipe assembly to any one of said manifold ports; and means for pivotally moving said lengths of pipe to position a first end of said pipe assembly relative to a second end of said pipe assembly.

7. A traveling loading arm as defined in claim 6 including braking means on each of said support carriages for selectively securing each of said carriages in a fixed position on said support rails.

8. A traveling loading arm as defined in claim 6 including means for mounting said support rails above said deck to extend said rails outwardly over the railing of said tanker to facilitate extending said end of said pipe assembly over the side of said tanker.

9. A traveling loading arm as defined in claim 6 wherein said means for pivotally moving said length of pipe includes a hydraulic cylinder having a piston rod movably mounted therein, means for connecting said hydraulic cylinder to one of said lengths of pipe and means for connecting said piston rod to the other of said lengths of pipe.

10. A traveling loading arm as defined in claim 6 wherein said support carriages each includes means for raising and lowering the end portion of said pipe assembly to facilitate connecting said end portion to said manifold ports.

11. A traveling loading arm as defined in claim 6 including means for raising said petroleum transfer hose into operating engagement with said end portion of said pipe assembly.

12. A traveling loading arm as defined in claim 6 wherein said support carriage includes means for raising said petroleum transfer hose into operating engagement with said end portion of said pipe assembly without pulling said transfer hose onto the deck of said tanker.

13. A traveling loading arm as defined in claim 6 including means for selectively securing the outboard end of said pipe assembly in a fixed position adjacent the outboard end of said support rails.

14. A traveling loading arm as defined in claim 6 including a plurality of control lines, and means for connecting said control lines between said support carriages.

* * * * *